US006766671B2

(12) United States Patent
Haczynski et al.

(10) Patent No.: US 6,766,671 B2
(45) Date of Patent: Jul. 27, 2004

(54) SHACKLELESS LOCK

(75) Inventors: Christopher Haczynski, Monee, IL (US); Troy A. Peterson, Valparaiso, IN (US)

(73) Assignee: Master Lock Company, Milwaukee, WI (US)

( * ) Notice: Subject to any disclaimer, the term of this patent is extended or adjusted under 35 U.S.C. 154(b) by 0 days.

(21) Appl. No.: 10/199,372

(22) Filed: Jul. 19, 2002

(65) Prior Publication Data

US 2004/0011092 A1 Jan. 22, 2004

(51) Int. Cl.[7] ..... E05B 37/06
(52) U.S. Cl. ..... 70/23; 70/33; 70/34; 70/56
(58) Field of Search ..... 70/2–13, 23, 32–34, 70/54–56

(56) References Cited

U.S. PATENT DOCUMENTS

| | | | | | |
|---|---|---|---|---|---|
| 3,404,549 | A | | 10/1968 | Best | |
| 3,769,821 | A | | 11/1973 | Randel | |
| 3,820,360 | A | | 6/1974 | Best | |
| 3,996,774 | A | | 12/1976 | Best | |
| 4,183,235 | A | * | 1/1980 | Coralli et al. | 70/34 |
| 4,307,904 | A | | 12/1981 | Daus | |
| 4,512,165 | A | * | 4/1985 | Uyeda | 70/32 |
| 4,754,626 | A | * | 7/1988 | Siegel | 70/32 |
| 4,761,975 | A | | 8/1988 | Kachnowski et al. | |
| 4,866,960 | A | | 9/1989 | Brower | |
| 4,915,257 | A | | 4/1990 | Bailey | |
| 4,949,560 | A | | 8/1990 | Anderson | |
| 5,127,244 | A | * | 7/1992 | Myers | 70/2 |
| 5,172,574 | A | | 12/1992 | Perfetto | |
| 5,174,135 | A | | 12/1992 | Loughlin | |
| D336,030 | S | * | 6/1993 | Falk et al. | D8/334 |
| 5,345,794 | A | * | 9/1994 | Jenks | 70/32 X |
| 5,365,758 | A | * | 11/1994 | Shieh | 70/33 |
| 5,442,941 | A | * | 8/1995 | Kahonen et al. | 70/34 |
| 5,469,722 | A | * | 11/1995 | Ellefsen | 70/56 |
| 5,517,837 | A | * | 5/1996 | Wang | 70/33 X |
| 5,669,255 | A | | 9/1997 | Albano | |
| 5,682,775 | A | * | 11/1997 | Baber | 70/34 |
| 5,713,224 | A | * | 2/1998 | Liou | 70/34 |
| 5,946,952 | A | | 9/1999 | Mintchenko | |
| 5,964,107 | A | * | 10/1999 | Chang | 70/33 |
| 5,975,595 | A | | 11/1999 | Lorenzo | |
| 5,987,939 | A | * | 11/1999 | Pitisettakarn | 70/33 |
| 6,009,731 | A | | 1/2000 | Emmons et al. | |
| 6,233,984 | B1 | | 5/2001 | Blehi, III | |
| 6,338,261 | B1 | * | 1/2002 | Liu | 70/34 |
| 6,357,266 | B1 | * | 3/2002 | Van Buren | 70/56 |
| 6,453,706 | B1 | * | 9/2002 | Chen | 70/33 |
| 6,467,317 | B1 | * | 10/2002 | Hillabush et al. | 70/56 |

* cited by examiner

*Primary Examiner*—Suzanne Dino Barrett
(74) *Attorney, Agent, or Firm*—Calfee, Halter & Griswold, LLP

(57) ABSTRACT

A high-security shackleless lock is provided. The lock includes a shackle pin adapted to move between a closed position extending across a lock body recess to engage a staple; and an open, staple-free position. A lock bar mounted entirely within the lock body can be move between a closed shackle pin engaging position to retain the shackle pin in its staple-engaging position, and an open shackle pin-free position wherein the shackle pin does not extend across the lock body and cannot engage a staple. A shackle pin spring urges the shackle into its open position, and a lock bar spring urges the lock bar into its closed position. The shackle pin has a distal end formed with a head element of extended dimensions. The lock body defines a recess adapted to closely confront the shackle pin head when the shackle pin is located in its closed position.

17 Claims, 5 Drawing Sheets

SHACKLELESS LOCK

This invention relates generally to high-security hasp locks, and more particularly to shackleless cylindrical padlocks which can be used with or without protective guards.

High-security padlocks have become increasingly important in securing truck bodies, slot machines, automatic teller machines and other areas and equipment against unauthorized entry. A number of high-security padlocks have generally short, cylindrical body shapes, and they are sometimes generically referred to as hockey-puck locks. Locks of this sort are shown in Best U.S. Pat. No. 3,404,549; Randel U.S. Pat. No. 3,769,821; and Best U.S. Pat. No. 3,820,360.

To further enhance the security afforded by these locks, guards have been designed to surround the lock bodies and prevent or inhibit the lock bodies from attack by pry bars, jimmies or other instruments. Guards of this short are shown in Perfetto U.S. Pat. No. 5,172,574; and Albano U.S. Pat. No. 5,669,255. Some of these locks and guard systems are relatively expensive to manufacture and are relatively difficult and time-consuming to assemble.

It is a general object of this invention to provide a cylindrical padlock having a relatively great resistance to attack, yet which has relatively few parts and which can be manufactured and assembled relatively quickly and easily.

It is a more specific object to provide a lock of this sort in which the lock mechanism is located entirely within an attack-resistant lock body when the lock is in its locked configuration.

It is another object to provide a shackleless cylindrical padlock in which the lock mechanism is shaped and configured so that it cannot be easily attacked by a drill, jimmy, pry bar, pick, or other tool.

Other objects and advantages of the invention will become apparent upon reading the following detailed description and upon reference to the drawings. Throughout the drawings, like reference numerals referred to light parts.

DETAILED DESCRIPTION OF THE DRAWINGS

While the invention will be described in connection with a preferred embodiment and procedure, it will be understood that it is not intended to limit the invention to this embodiment or procedure. On the contrary, it is intended to cover all alternatives, modifications and equivalents as may be included within the spirit and scope of the invention as defined by the appended claims.

Figure 1:
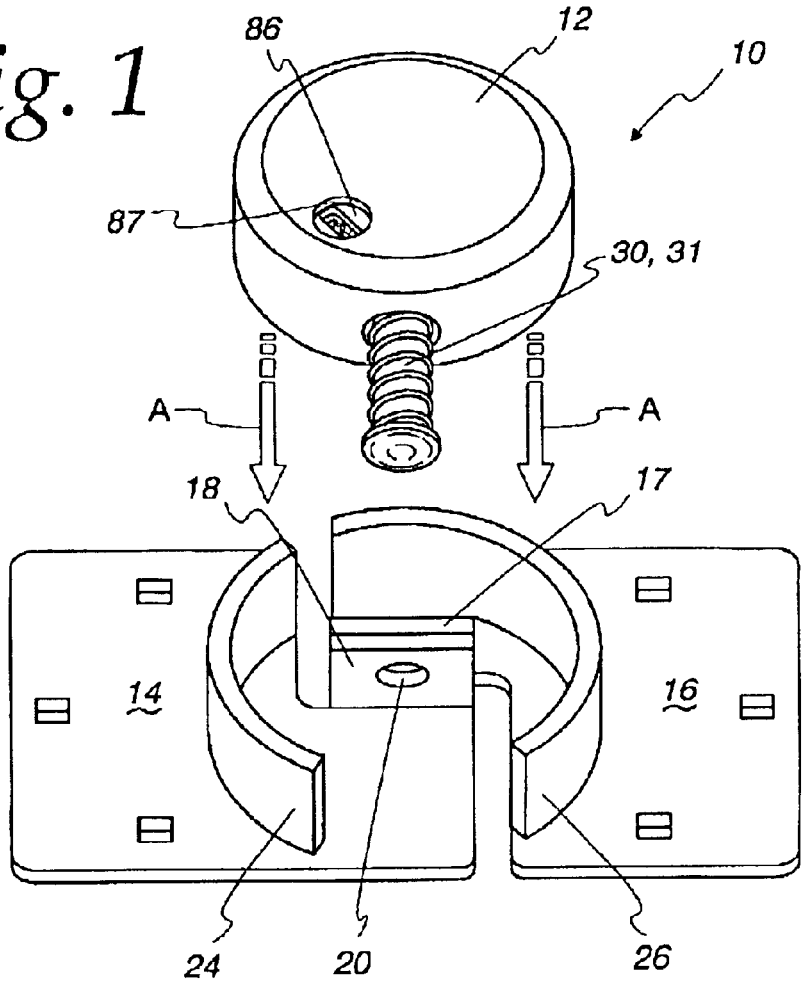
FIG. 1 is an isometric view showing a lock having the novel design as that lock appears when the lock is ready for installation over a hasp and within a guard.

Turning first to FIG. 1, a cylindrical or hockey-puck style lock 10 having a unitary lock body shell 12 is sized and shaped to lock together first and second hasp plates 14 and 16. These hasp plates 14, 16 can be bolted or otherwise firmly secured to a movable access cover and an adjacent fixed member of a structure to be secured by the lock 10. For example, one hasp plate 14 could be secured to a door (not shown) of an enclosure, and the mating hasp plate 16 could be secured to an adjacent doorjamb (not shown).

Staple flanges 17 and 18 can be turned perpendicularly upwardly from the respective hasp plates 14, 16. Eyes or holes 20 in registry with one another can be provided to extend through the adjacent, confronting staple flanges 17, 18. The lock body and hasps, staples and guides can be formed from steels of appropriate formulation or from other suitable material.

Hasp guard elements 24, 26 extend perpendicularly upwardly from the respective hasp plates 14, 16. As suggested particularly in FIG. 2, these hasp guard plates 24, 26 are curved so as to closely confront and enclose the cylindrical lock body 12. The guard plates 24, 26 can be unitarily formed with the hasp plates 14, 16, or they can be welded or otherwise securely attached to the hasp plates 14, 16. When the lock 10 is installed over the staples 17, 18, the lock 10 covers the staple 17, 18, and the guards 24, 26 surround the lock and prevent access to the lock 10, thus providing an integrated but easy to use high security lock and lock system.

Figure 2:
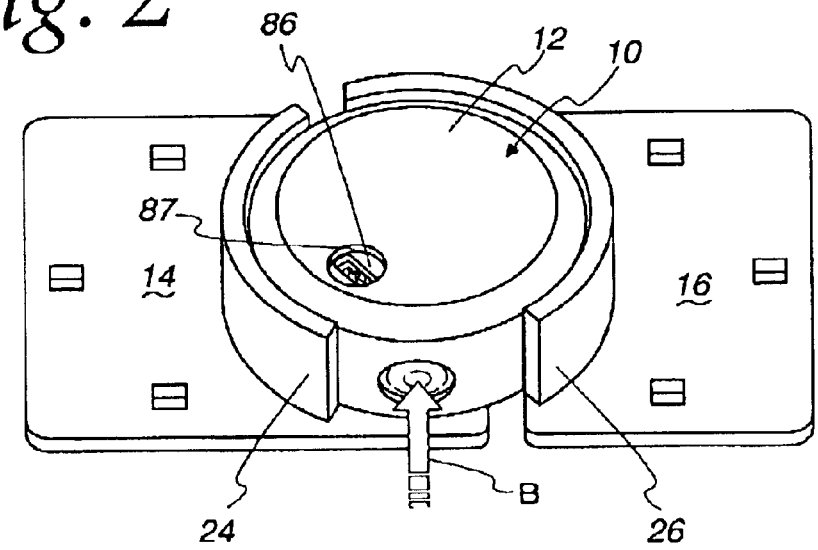
FIG. 2 is an isometric view similar to FIG. 1 but showing the lock as it appears when it has been installed over the hasp and within the guard.

The lock 10 is installed by simply closing the cover or door or other structure so as to locate the hasp plates 14, 16 and the respective guard plates 24, 26 in the configuration shown in FIGS. 1 and 2, and then inserting the lock 10 into the enclosure at least partly formed by the guard plates 24, 26, as suggested in FIG. 2 and the arrows A in FIG. 1. A lock shackle pin 30 is then pushed inwardly from its lock open position shown in FIG. 1 so as to extend through the staple eyes 20 and into the lock closed position suggested by the arrow B in FIG. 2 so as to put the lock 10 in its closed, locked configuration.

Figures 3, 4:
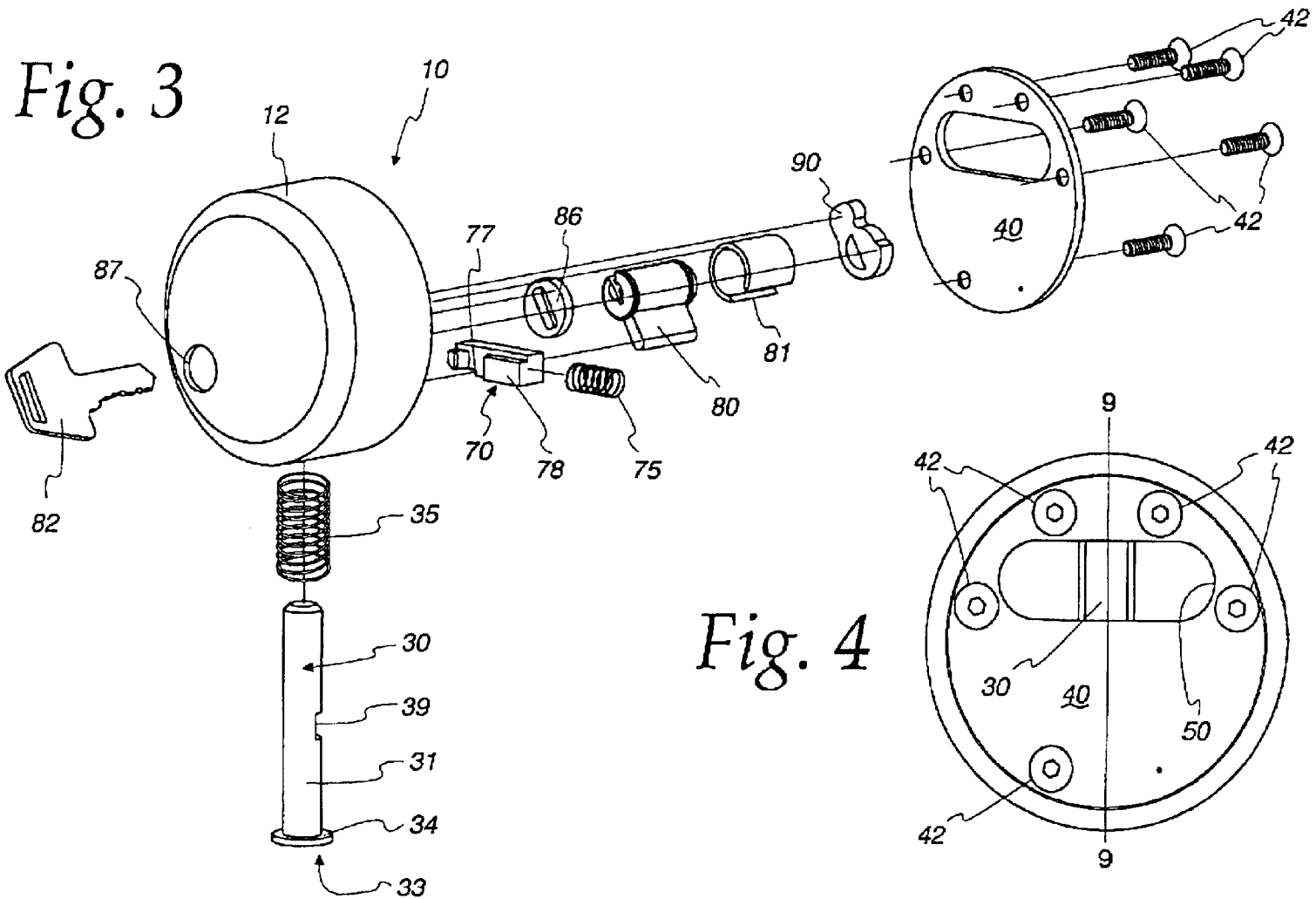
FIG. 3 is an exploded view of the lock showing the lock body and lock mechanism parts.
FIG. 4 is an elevational or plan view showing the back of the lock.
Figure 6:
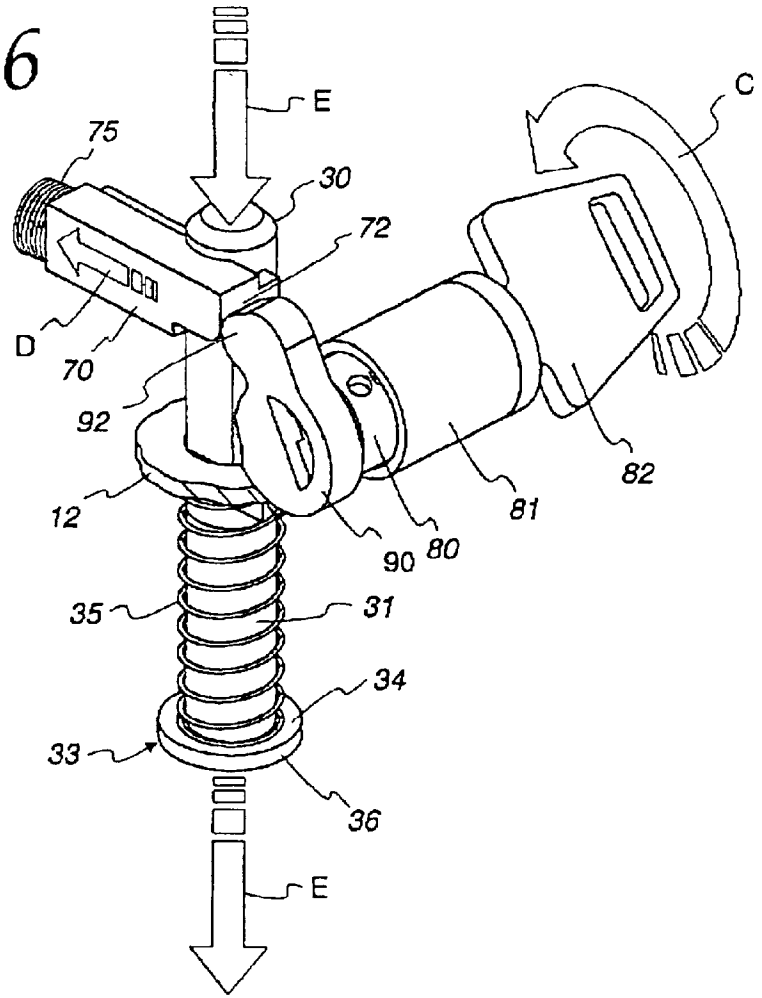
FIG. 6 is an isometric view similar to FIG. 5 but showing the lock mechanism parts as they are configured when the lock is in its open, unlocked configuration.

A cover plate 40 extends across the back of the lock body 12 and is secured in place by a number of screws 42 or other convenient means as shown in FIGS. 3 and 4. The cover plate 40 is open to and partly defines a recess 50. Other portions of the recess 50 are defined by surfaces which are machined or otherwise formed in the lock body 12. When the shackle pin 30 extends across the recess 50 as shown in FIG. 4, it is located in its closed position and it can engage one or both of the staples 17, 18. In this configuration, the pin 30 is positioned substantially entirely within the lock body 12. When the shackle pin 30 is located in its open position, it is withdrawn from the recess 50 and does not extend across the recess and lock body. A distal portion 31 of the pin is positioned outside the lock body when the shackle pin 30 is in its open, staple free position or configuration as suggested in FIG. 1. To inhibit or prohibit tampering with the interior lock mechanism in accordance with one aspect of the invention, the shackle pin 30 is provided with an expanded head 33 of greater transverse dimension than adjacent stem portions of the shackle pin 30 as illustrated particularly in FIG. 9. As shown in FIGS. 6 and 9, the head 33 is partly defined by an undercut surface 34 which engages a shackle pin spring element 35. The head element 33 is further defined by a circumferential surface 36 oriented substantially perpendicularly to the undercut surface 34 and parallel to the longitudinal axis of the shackle pin 30. As suggested in FIGS. 5–8, the shackle pin spring 35 is compressed between the lock body 12 and the head undercut surface 34.

As shown in FIG. 9, the lock body 12 defines a pin head-accepting recess 60 having lock body recess surfaces 61, 62 adapted to closely confront the shackle pin and distal pin head 33 when the shackle pin 30 is located in its closed, shackle pin-engaging position. Orienting the recess surfaces substantially perpendicular to one another and arranging those recess surfaces so as to closely confront the surfaces of the pin head 33 prevents or inhibits attacks on the shackle pin and lock body interior by picks or like instruments of intrusion. The pin head 33 includes a crowned top 38 surface for inhibiting attack by a drill or other instrument of intrusion.

It is a feature of the invention that the shackle pin 30 can be moved between its open and closed positions by simple structure which is easy to manufacture and assemble. To this end, in accordance with the invention, a lock bar 70 is mounted entirely within slide retainer recesses (not shown) conventionally formed in the lock body. When the lock bar 70 is properly assembled in the lock body, the lock bar 70 is movable along a straight linear path between the shackle pin closed position and the shackle pin open position. In the shackle pin closed position, the lock bar 70 locks or retains the shackle pin 30 in its staple-engaging position. In the open position, the lock bar 70 permits the shackle pin spring 35 to push the shackle pin 30 partly out of the lock body 12 and into an open, shackle-pin-free position in which the shackle pin does not extend across the lock body recess and cannot engage a staple, as suggested in FIGS. 4, 5 and 6.

The shackle pin biasing element (here, a coil spring) 35 extends between the lock body 12 and the shackle pin head 33 of extended diameter and is compressed to urge the shackle pin 30 into its open position. It will be noted that, in accordance with one aspect of the invention, the shackle pin biasing element 35 urges the shackle pin 30 into its open position, and the lock bar biasing element (here, a coil spring) 75 urges the lock bar 70 into its closed position.

Figure 5:
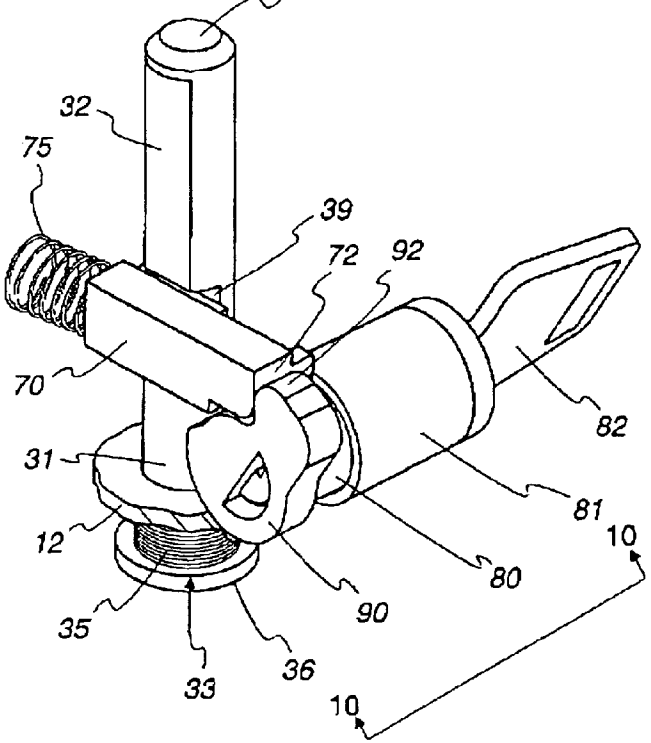
FIG. 5 is an isometric view showing the lock mechanism parts as they are configured when the lock is in its closed, locked configuration.

The lock bar 70 can be driven from its closed position shown in FIG. 5 to its open position shown in FIG. 6. To accomplish this in accordance with the invention, the novel lock 10 is provided with a conventional FIG. 8 lock mechanism 80 having a key 82 and a novel driver element 90 as illustrated in FIGS. 5–8. The lock mechanism is surrounded by a sleeve 81.

A lock mechanism retainer 86 covers the lock mechanism key entry aperture 87. That key 82 can be inserted or removed from the lock when the lock is either in its locked or its unlocked configuration.

Figure 8:
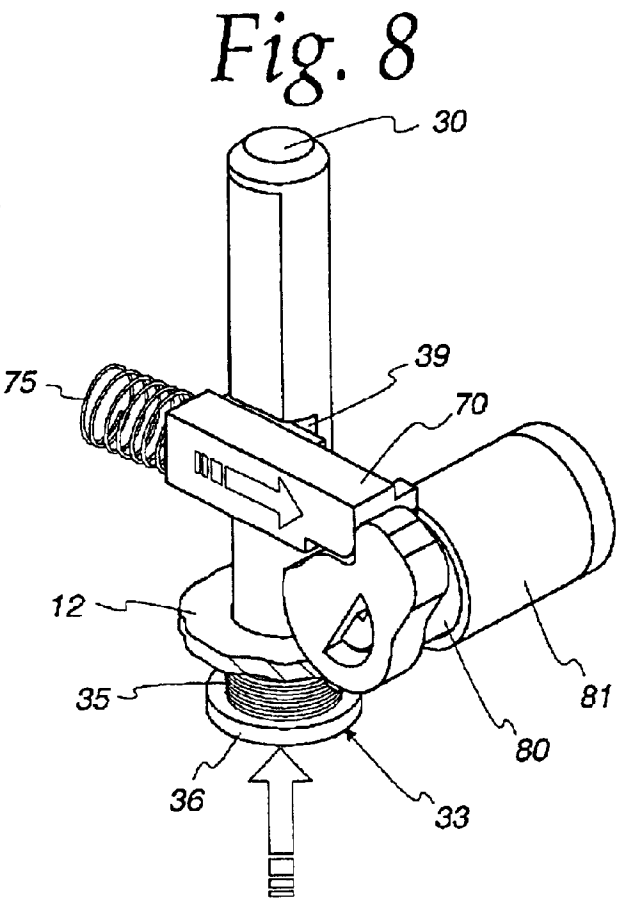
FIG. 8 is an isometric view similar to FIG. 7 but showing the positions and configuration of the parts when the shackle pin is moved from its open position to its closed, locked position.
Figure 7:
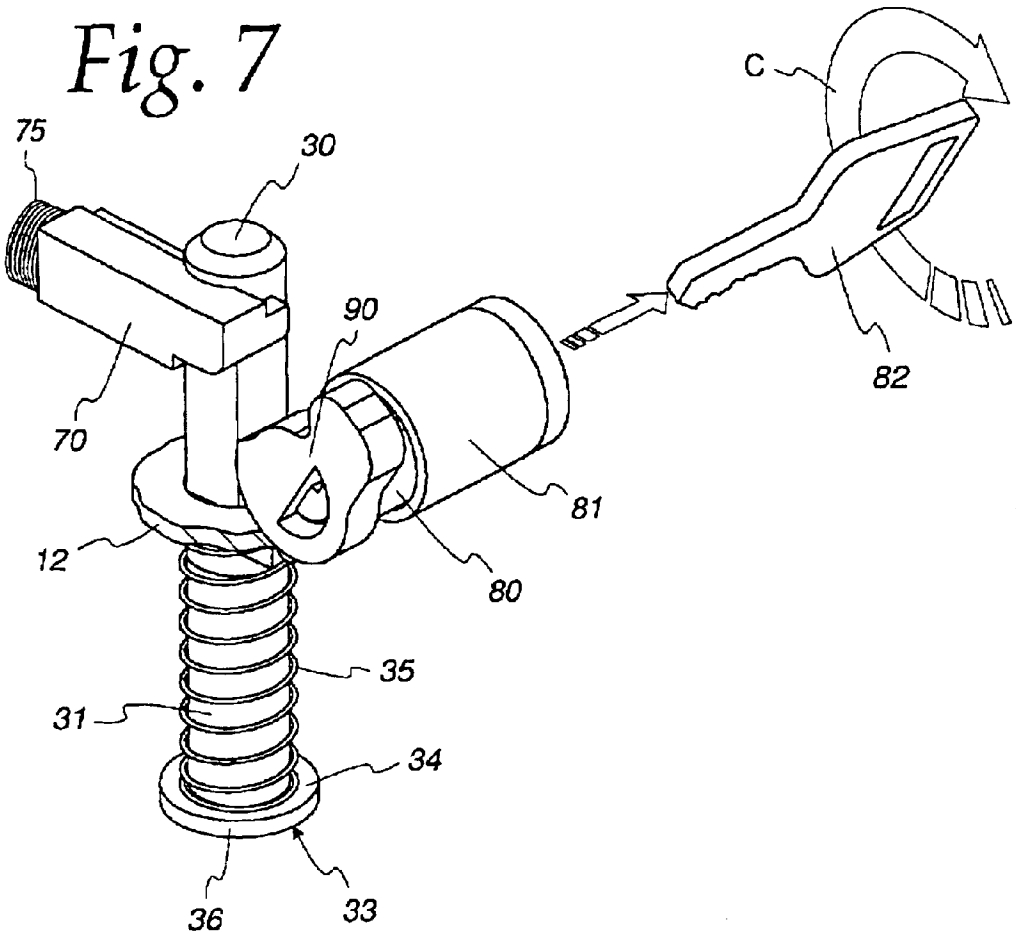
FIG. 7 is an isometric view similar to FIG. 6 but showing the position and configuration of the parts when the lock is open and the lock key is withdrawn from the lock body.
Figure 9:
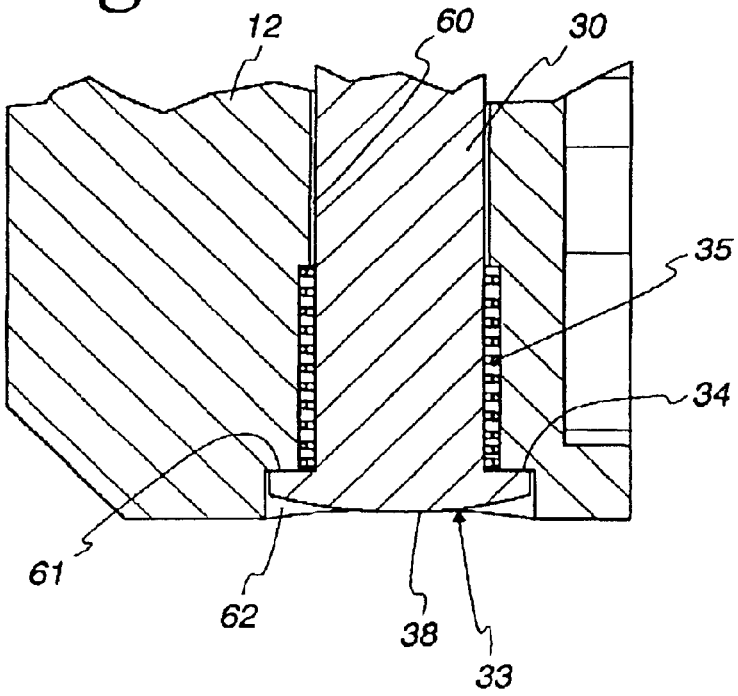
FIG. 9 is a sectional view taken substantially in the plane of line 9—9 in FIG. 4.
Figure 10:
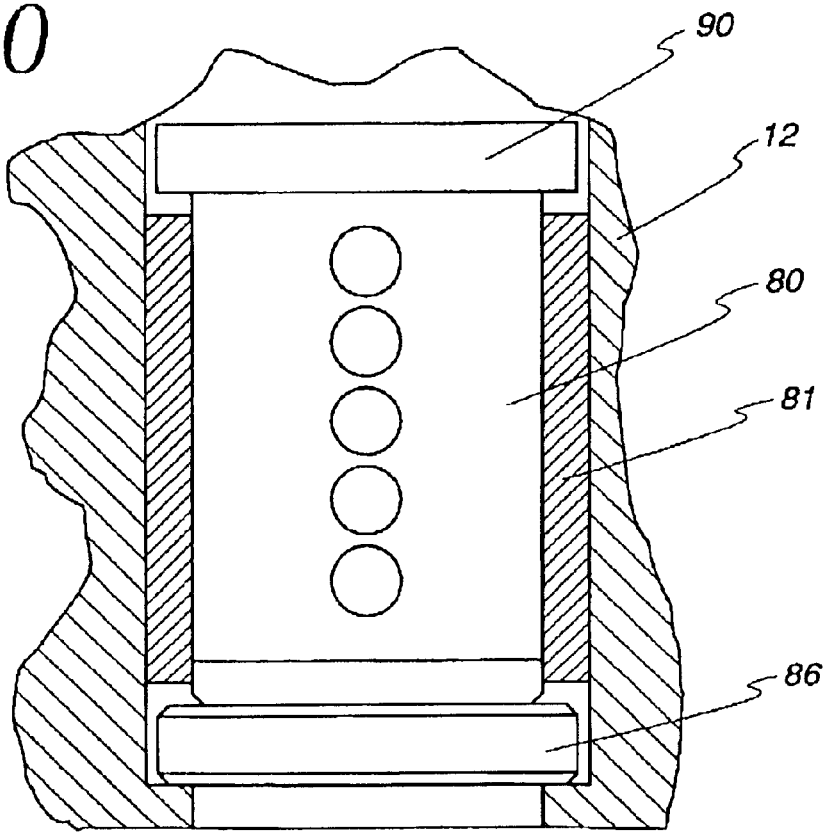
FIG. 10 is a developed view of the lock mechanism and associated parts taken in the direction suggested by line 10—10 in FIG. 5.

A lock bar biasing element (here, a coil spring 75) normally urges the lock bar 70 into its closed, shackle-retaining position shown in FIG. 5 and 8. When a lock user rotates the key 82 into its unlocked position as suggested by the arrow C in FIG. 6, the driver 90 pushes the lock bar 70 into the lock bar open position as suggested by the arrow D in FIG. 6 against the force supplied by the lock bar spring 75. To provide smooth, positive motion of the lock mechanism 80, the lock driver 90 and the lock bar 70, the driver 90 is provided with an external rounded head cam surface 92 and the lock bar 70 is provided with a confronting flat surface 72 to be engaged by the driver cam surface 92. This cam surface 92 and the flat lock bar follower surface 72 interact so as to move the lock bar 70 with smooth, predictable motion as the driver 90 is rotated by the lock mechanism 80.

The inter-engagement of the shackle pin 30 and the lock bar 70 are especially shown in FIGS. 3 and 5–8. The shackle pin 30 is provided with a flat 32; and the lock bar 70, of generally rectilinear shape, is provided with a relief 77 and an embossment 78 which normally engages a slot or cut-out relief 39 formed in the shackle pin 30 to retain the shackle pin in its closed, locked position against the biasing force of the shackle pin spring 35. When the lock bar 70 is pushed from its closed position shown in FIG. 5 into its open position shown in FIG. 6, the relief 77 is brought into confrontation with the shackle pin 30, thereby permitting part of the shackle pin 30 to pass over the lock bar 70 from the locked position shown in FIG. 5 to the open position shown in FIG. 6 as suggested by the arrows E. A flat 32 on the shackle pin 30 engages the lock bar relief 77 so as to prohibit the shackle pin 30 or lock bar 70 from rotating into misaligned configurations. In addition, the shape and diameter size of that portion of the shackle pin 30 which is above the flat 32 operates to retain the shackle pin 30 in the lock, so that it cannot pass completely past the lock bar 70 regardless of whether the shackled in is in its open or closed position. Thus, no additional components are required to retain the shackle pin 30 in the lock.

What is claimed is:

1. A shackleless lock, comprising, in combination, a lock body defining a recess to receive a staple therein; a shackle pin adapted to move between a closed position extending across the lock body recess to engage a staple, and an open, staple-free position wherein the shackle pin does not extend across the lock body; and a lock bar positioned entirely within the lock body and being movable along a straight linear path between a closed shackle-pin-engaging position to retain the shackle pin in its staple-engaging position, and an open, shackle pin-free position wherein the shackle pin does not extend across the lock body and cannot engage a staple.

2. A shackleless lock according to claim 1 further including a lock mechanism adapted to be moved between a locked configuration in which the shackle pin is in its staple-engaging position, and unlocked configuration in which the shackle pin is in its staple-free position.

3. A shackleless lock according to claim 1 wherein the lock body has a cylindrical shape.

4. A shackleless lock according to claim 3 wherein the lock body further comprises a unitary shell.

5. A shackleless lock according to claim 1 wherein said shackle pin is positioned substantially entirely within the lock body when the shackle pin is in its closed position.

6. A shackleless lock according to claim 1 wherein a portion of said shackle pin is positioned outside the lock body when the shackle pin is in its open, staple free position.

7. A shackleless lock according to claim 1 further including a shackle pin biasing element for biasing the shackle pin into its open, staple-free, position.

8. A shackleless lock according to claim 1 further including a lock bar biasing element for biasing the lock bar into its closed, shackle pin retaining position.

9. A shackleless lock according to claim 1 further including a lock mechanism and a driver element for engaging the lock mechanism and said lock bar for urging the lock bar into its open shackle pin-free position when the lock mechanism is configured in its locked position.

10. A shackleless lock according to claim 1 wherein said shackle pin has a distal end, the distal end including a head element of greater transverse dimension than adjacent stem portions of the shackle pin, the head element being further defined by an undercut surface extending substantially perpendicularly to the longitudinal axis of the shackle pin, and the head element being further defined by a circumferential surface oriented substantially perpendicularly to the undercut surface and parallel to the longitudinal axis of the shackle pin.

11. A shackleless lock according to claim 10 where the lock body defines a shackle pin head-receiving recess, the recess being at least partly defined by a relieved surface extending substantially parallel to and confronting the shackle pin undercut surface, and by a circumferential surface confronting and parallel to the shackle pin circumferential surface.

12. A shackleless lock according to claim 1 wherein said lock further includes a lock bar embossment for engaging a relief in the shackle pin when the lock bar and the shackle pin are in their closed positions.

13. A shackleless lock according to claim 10 wherein the shackleless lock further includes a shackle pin biasing element engaging the shackle pin head undercut surface and a portion of the lock body.

14. A shackleless lock according to claim 8 wherein said lock bar element and lock bar biasing means are arranged so that said lock bar is biased into its closed position.

15. A shackleless lock according to claim 1 wherein said shackle pin is partly defined by a flat surface and said lock bar is partly defined by a flat surface and a relief, the shackle pin flat surface and the lock bar flat surface interacting so as to prevent the shackle pin from rotating, yet permitting the shackle pin to slide past the lock bar over a portion of the shackle pin length when the lock bar relief directly confronts the shackle pin.

16. A shackleless lock according to claim 1 wherein said driver includes an external rounded head cam surface for engaging the lock bar so as to move the lock bar with smooth, predictable motion as the driver is rotated by the lock mechanism.

17. A shackleless lock, comprising, in combination, a lock body defining a recess to receive a staple therein; a shackle pin adapted to move between a closed position extending across the lock in body recess to engage a staple, and an open, staple-free position wherein the shackle pin does not extend across a lot body recess; a shackle pin adapted to move between a closed position extending across the lock body recess to engage a staple, and an open, staple-free position wherein the shackle pin does not extend across the lock body; a lock bar mounted entirely within the lock body and being movable between a closed shackle-pin-engaging position to retain the shackle pin in its staple-engaging position, and an open shackle pin-free position wherein the shackle pin does not extend across the lock body and cannot engage a staple; a shackle pin biasing element for biasing the shackle pin into its open, staple-free position; and a lock bar biasing element for biasing the lock bar into its closed, shackle pin retaining position.

* * * * *